US008561759B2

(12) United States Patent
Monks et al.

(10) Patent No.: US 8,561,759 B2
(45) Date of Patent: Oct. 22, 2013

(54) RESCUE ARRANGEMENT

(75) Inventors: Nicholas Paul Monks, Tilburg (NL); Marlies Van Dullemen, Leiden (NL); Ingmar Christiaan Maurice, Amsterdam (NL); Marte Jeane Den Hollander, The Hague (NL)

(73) Assignee: Rapid Vertical Egress System Holding B.V., Tilburg (NL)

( * ) Notice: Subject to any disclaimer, the term of this patent is extended or adjusted under 35 U.S.C. 154(b) by 166 days.

(21) Appl. No.: 12/920,102

(22) PCT Filed: Feb. 27, 2008

(86) PCT No.: PCT/NL2008/000058

§ 371 (c)(1),
(2), (4) Date: Nov. 30, 2010

(87) PCT Pub. No.: WO2009/108040

PCT Pub. Date: Sep. 3, 2009

(65) Prior Publication Data

US 2011/0061971 A1 Mar. 17, 2011

(51) Int. Cl.
*A62B 1/02* (2006.01)

(52) U.S. Cl.
USPC ..... 182/82

(58) Field of Classification Search
USPC ..... 182/82
See application file for complete search history.

(56) References Cited

U.S. PATENT DOCUMENTS

| | | | | |
|---|---|---|---|---|
| 5,277,125 | A * | 1/1994 | DiFonso et al. | 104/292 |
| 6,659,237 | B1 * | 12/2003 | Pribonic | 188/165 |
| 6,817,443 | B1 * | 11/2004 | Metz | 182/82 |
| 6,830,126 | B2 * | 12/2004 | Godwin | 182/82 |
| 6,918,469 | B1 | 7/2005 | Pribonic et al. | |
| 7,594,281 | B1 * | 9/2009 | Stinson et al. | 2/456 |
| 7,703,576 | B2 * | 4/2010 | Grabowski | 182/82 |
| 2004/0055836 | A1 | 3/2004 | Pribonic et al. | |
| 2006/0108177 | A1 * | 5/2006 | Monks | 182/82 |

FOREIGN PATENT DOCUMENTS

| | | | |
|---|---|---|---|
| GB | 2393652 | A | 4/2004 |
| GB | 2437949 | A | 11/2007 |
| JP | 09277984 | A * | 10/1997 |
| WO | WO0160654 | A1 | 8/2001 |

* cited by examiner

*Primary Examiner* — Alvin Chin Shue
(74) *Attorney, Agent, or Firm* — Browdy and Neimark, PLLC

(57) ABSTRACT

The invention relates to a rescue arrangement for effecting a rapid descent from a higher level to a lower level. The rescue arrangement comprises guiding means which extend between the higher level and the lower level, as well as carrying means which are connectable to the guiding means for carrying a person or another object from the higher level to the lower level along the guiding means. Magnetic braking means, which comprise a series of permanent magnets, are located on the guiding means or the carrying means for slowing down the carrying means at least near the lower end of the guiding means.

15 Claims, 19 Drawing Sheets

RESCUE ARRANGEMENT

FIELD OF THE INVENTION

The present invention relates to a (mass-) rescue arrangement for effecting a rapid descent from a higher level to a lower level. Such rescue arrangements can be used for rapid descent from a high-rise building in the event of an emergency.

During an emergency situation, like for instance a fire, in a high-rise building, the persons in the building are not allowed to use the elevators to get to the ground floor and exit the building. Furthermore the use of the staircases in the building can take too long when people are on a high level or might be impassable. Therefore, rescue arrangements are necessary that facilitate persons in the building to exit and descend on the outside of the building.

From US 2006/0108177 to Monks a rescue arrangement is known for effecting a rapid descent from a higher level to a lower level. This known rescue arrangement comprises guiding means which extend between the higher level and the lower level. Furthermore it comprises carrying means which are connectable to the guiding means for carrying a person or another object from the higher level to the lower level along the guiding means. Magnetic braking means are located on the guiding means for slowing down the carrying means.

The object of the present invention is to provide an improved rescue arrangement.

SUMMARY OF THE INVENTION

According to a first aspect of the invention this object is achieved by a rescue arrangement for effecting a rapid descent from a higher level to a lower level, wherein the rescue arrangement comprises guiding means which extend between the higher level and the lower level, as well as carrying means which are connectable to the guiding means for carrying a person or another object from the higher level to the lower level along the guiding means. The rescue arrangement furthermore comprises magnetic braking means located on the guiding means or the carrying means for slowing down the carrying means at least near the lower end of the guiding means, wherein the magnetic braking means comprise a series of permanent magnets.

The use of permanent magnets for braking the carrying means and controlling the speed of descent is advantageous because its functioning is not depending on any power supply.

In a preferred embodiment at least two substantially parallel rows of permanent magnets are arranged along the guiding means near its lower end, said rows delimiting at least one slot between them, wherein the carrying means are provided with at least one braking member, which travels within the slot(s) between the rows of magnets at the end stage of the descent of the carrying means along the guiding means. The parallel rows of permanent magnets create a magnetic field in the slot. The braking member travelling through the slot(s) disturbs the magnetic field and induces eddy currents, whereby a force opposite the direction of movement of the braking member is generated. These generated braking forces eventually would lead to a residual, steady movement, i.e. a movement with a constant velocity.

In other embodiments of the invention the slot(s) between the magnets can be wider at the top than further below, because the rows of magnets converge linearly from the upper region downwardly. Next to this linear converging shape the magnets can be placed in a slight curve forwards or backwards, e.g. closer to or further away from the carrying means horizontally and/or vertically. Different combinations of these are possible also. This enables to influence the deceleration of dissimilar loads towards a desired optimum, for instance achieving a similar deceleration independent of the weight of the person/load, and to mitigate peak deceleration loads.

The braking member is preferably formed as a fin. It is preferably made from electrically conductive material(s), in particular aluminium, copper or composite versions of these. Aluminium having the advantage that it leads to a lightweight structure, copper having the advantage of a stronger braking effect due to better conductivity.

In a preferred embodiment the fin is self-aligning, which means that it accurately and precisely guides itself into the narrow slot between the magnets, by using a spring loaded connection between the fin and the carrying means and a wheel arrangement on the guiding means with at least two rows of wheels, which rows in at least their upper region converge towards each other. The spring connection provides a shock absorbing feature which makes the ride more comfortable for the person travelling down at high speed. The alignment is, which induces shocks will be absorbed, but also shocks due to irregularities in the track can be absorbed.

Another preferred embodiment has a rigid connection between the carrying means and the fin and would in a similar way enable to guide the complete carrying means simultaneously with the fin. This provides a more simple structure of the carrying means, but could possibly require a more accurate fabrication of the track, because the descent could become too uncomfortable.

In one alternative embodiment the fin is self-adjusting such that it deploys more or less of its surface area within the slot between the magnets. This self-adjustment is determined by the speed and mass of the combined carrying means and load being transported. The advantage of this self-adjustment is that the brakes can apply more or less deceleration as required to safely arrest the descent without operator intervention and thus keep a similar descent speed and duration for lighter and heavier loads. This can be achieved by allowing the fin to move away from the carriage, on a spring-loaded fixation, effectively either translating or rotating the fin further into the slot. The same effect could otherwise be achieved by allowing part of the track to move horizontally while the rows of magnets stay in their fixed position, by the braking force on the fin pulling the car further into the slot.

In a preferred embodiment each magnet in one of the rows is directed in the same direction as the corresponding magnet in the other row.

All magnets of both rows can be directed in the same direction, in particular in a direction transverse to the direction of the slot. In a more preferred embodiment however, consecutive magnets in each row are directed in a diametrically opposite direction (180° rotation), being transverse to the direction of the slot. Such a configuration of magnets is known as such for the purpose of accelerating electrons and is then called wiggler or undulator. This leads to a braking force which can be about four times higher than when all magnets of both rows are directed in the same direction.

In another preferred embodiment consecutive magnets in one of the rows are rotated clockwise by 90° relative to the previous magnet in the same row, and wherein consecutive magnets in the adjacent row are similarly rotated counterclockwise by 90°. Such a configuration of magnets is known as a Halbach array. Preferably each magnet, directed transversely with respect to the slot in one of the rows, is directed in the same direction as the corresponding magnet in the other row. Alternatively, each magnet, directed transversely with respect to the slot, in one of the rows is directed in the opposite direction as the corresponding magnet in the other row.

Preferably the guiding means at the lower end are adapted to allow the carrying means to be dropped off. In this way the carrying means are automatically decoupled from the guiding means and the person is removed quickly from the track, thereby allowing another person to arrive at the bottom without delays consequent upon decoupling.

Preferably a chute is positioned under the lower end of the guiding means, such that the dropped-off carrying means are caught and slid out of the path of the next user in order to prevent collisions between successive users.

In a preferred embodiment the magnets are chosen and configured in such a way that the carrying means at the end of the guiding means has a residual, steady movement. This is advantageous for removing the persons quickly from the track. In another embodiment another (conventional, friction) braking member is added to make the carriage come to a full stop at the exit of the guiding means.

Additionally magnetic brakes can be arranged along most of the length of the guiding means so as to provide an intermediate braking along the track. The preferred arrangement for intermediate braking however, is to have a set of magnets on the carrying means, with similar magnet arrangements as the magnetic brakes at the end of track, which are guided along a fin element or other braking member which is integrated in the guiding means. When this magnet arrangement has a defined and self-adjusting, though limited, freedom of movement while being connected to the carrying means, this movement can be arranged in such a way that the braking force is governed by the weight of the person/load using the carrying means. The advantages to use intermediate braking include keeping the maximum velocity and acceleration within psychologically and medically acceptable limits and achieving an optimum capacity e.g. maximum number of users, because the weight regulating the braking force results in a substantially similar duration of descent for light and heavy loads (persons). Although not preferred at this moment it is conceivable to have a rescue arrangement where the only breaking means are the magnets on the carriage and the fin or the like on the guiding track.

In a preferred embodiment the guiding means comprise a track defined by rails.

The guiding means can have multiple feeding tracks from which the carrying means can be fed to the descending guiding means. An alternative embodiment could comprise a carousel which can be fed with different carrying means at the same time and will feed these, one after another, on to the descending guiding means. Thereby a number of persons can be made ready for descent simultaneously, after which they can enter the track consecutively within a small time interval, effectively increasing the total capacity of the entire system.

Another aspect of the invention relates to a rescue arrangement for effecting a rapid descent from a higher level to a lower level, the rescue arrangement comprising: guiding means which extend between the higher level and the lower level, carrying means which are connectable to the guiding means for carrying a person or another object from the higher level to the lower level along the guiding means, braking means located at the guiding means for slowing down the carrying means, wherein the carrying means comprise a carriage and a rescue suit to be worn by a person, wherein the carriage is adapted to be connected to the guiding means so as to descend along the guiding means and wherein the rescue suit is adapted to be coupled to the carriage.

In a preferred embodiment the rescue suit keeps the arms of the person wearing it close alongside his/her torso. In this manner the rescue suit keeps the person wearing it from (unintentionally or otherwise) wildly swinging his/her arms which could cause injury during the rapid descent from the building. The rescue suit also restrains items such as long hair, e.g. by a hood for covering the head, and loose clothing preventing that such might be caught inadvertently and undesirably during descent. The preferred rescue suit has means of adjustment to fit a large range of people by size, weight and shape.

An additional special rescue stretcher will carry injured or disabled people, infants, pets and others whom the suit does not fit by size, weight or shape. This can travel down the guiding means with the head up or in a horizontal lying position.

In another preferred embodiment the carriage has a head shelter for protecting the head of a person travelling with the carriage from falling debris. As the guiding means are generally positioned along the wall of the building, danger of falling debris could occur. The head shelter protects at least the head of the person travelling down with the carriage.

Preferably the carriage at its upper portion is provided with suspension brackets on each side and wherein the rescue suit is provided with coupling means for coupling the rescue suit to the suspension brackets.

In a preferred embodiment the rescue suit has a shoulder region which is provided with coupling means for coupling with the suspension bracket. The person wearing the rescue suit is in this way hanging from his shoulders to the carriage.

In a further preferred embodiment the rescue suit has an upper leg region which is provided with further coupling means for coupling with the suspension brackets, thereby keeping the legs of the person wearing the suit in a lifted position. In this manner the person wearing the suit is effectively sitting in the suit. An embodiment with lifted leg fixation only is possible as well.

Preferably the rescue arrangement comprises a number of carriages, which carriages can be stackable. The persons in the building can be all provided with a personal rescue suit, which they can put on in case of an emergency. This is comparable with an airplane where each passenger has a life vest stowed under his seat. They can then proceed towards a feed location where carriages are stacked. Trained staff can then attach each person to an individual carriage which is then be placed on a feed track. Placing the carriage on the feed track can be arranged by a carrousel feed system, which at station one is loaded with at least one carriage, which at station two (or more) can be loaded with one or more persons, and at the final station is fed towards the guiding means.

Next, the carriage can be moved to the guiding means and can be released for the rapid descent. At the lower end of the guiding means the carriages are dropped of with the persons carrying them. After the persons have moved out of the way of the next descending person the carriage can be taken off and stacked again.

In an alternative embodiment the carrying means as described above can be integrated into a single item such that the carriage is integrated into the back of the rescue suit. This integrated embodiment functions identically to the two-piece embodiment after they have been joined together thus achieving the same physical functions.

The invention will be explained further in the following detailed description with reference to the drawings:

DETAILED DESCRIPTION

Figure 1:
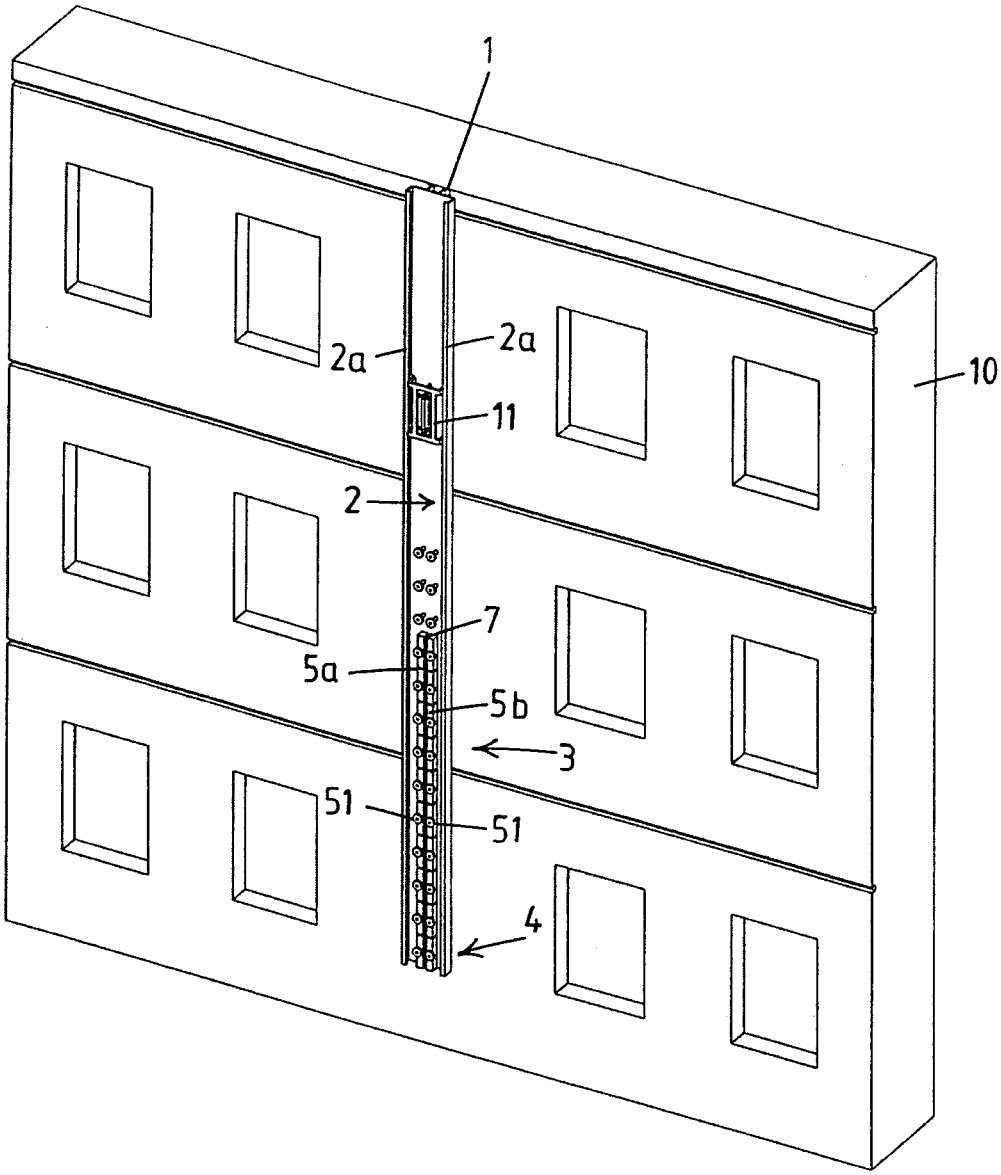
FIG. 1 shows by way of example a lower region of the guiding means of a rescue arrangement according to the invention mounted on a building.

In FIG. 1 is shown an example of a lower region of a rescue arrangement for effecting a rapid descent from a higher level to a lower level. The rescue arrangement comprises a guiding fixation 1 provided with a guiding track 2 comprising guiding rails 2*a*. The fixation 1 is for instance positioned on or next to a high rise building 10, or integrated in the structure of such a building 10 as is shown in the figure. The carrying means, which will be described further below in this description with reference to FIGS. 10-18, and which is shown partly in the figure indicated by reference numeral 11, can be coupled to and travel along the guiding track 2. The carrying means are adapted to carry a person from the higher level to the lower level along the guiding track 2.

Figure 2:
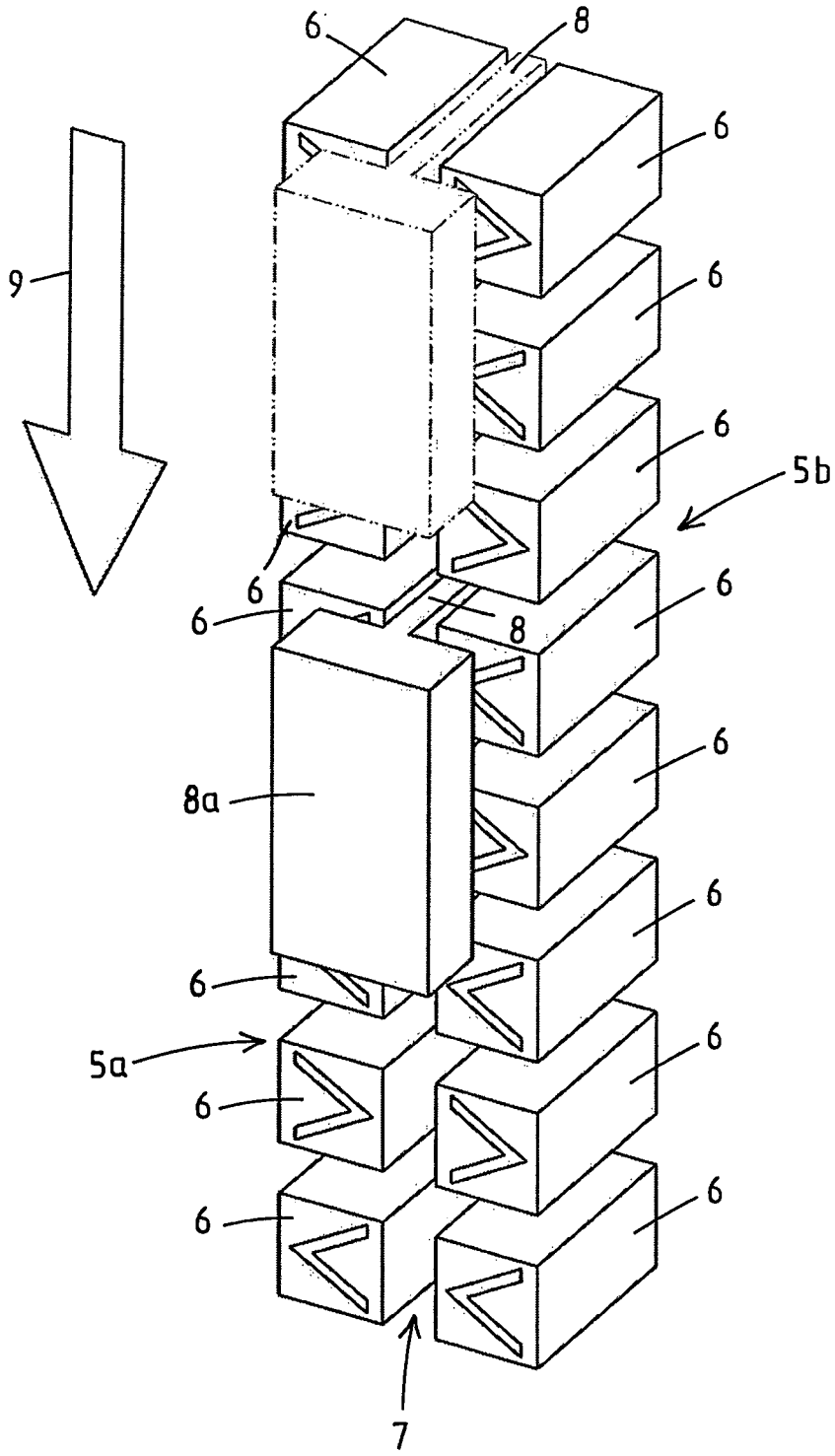
FIG. 2 shows a schematical representation of a preferred embodiment of magnetic braking means according to the invention.

In the region 3 near the lower end 4 of the descending means a series of permanent magnets 6 are arranged in row like manner in the direction of the guiding track 2. In the embodiment shown two parallel rows 5*a* and 5*b* respectively of magnets 6 are arranged, which rows 5*a*, 5*b* delimit a slot 7 between them. In FIG. 2 the rows 5*a* and 5*b* are illustrated in more detail. The carrying means 11 of the rescue arrangement have a braking member in the form of a fin 8. The fin 8 is in the example shown integral with a mounting block 8*a*. When the carrying means 11 travels along the guiding track 2 at the location of the rows 5*a*, 5*b* of magnets, the fin 8 travels through the slot 7 between the rows 5*a*, 5*b* of magnets 6. The parallel rows 5*a*, 5*b* of permanent magnets 6 create a magnetic field in the slot 7. The fin 8 travelling through the slot 7 disturbs the magnetic field and induces eddy currents, whereby a force opposite the direction of movement, which is indicated by arrow 9, of the fin 8 is generated. These generated braking forces eventually would lead to a residual, steady movement of the carrying means 11, i.e. a movement with a constant velocity.

The fin 8 can be made of a magnetic material but also of an electrically conductive material such as aluminium, copper or a combination thereof.

Figure 4:
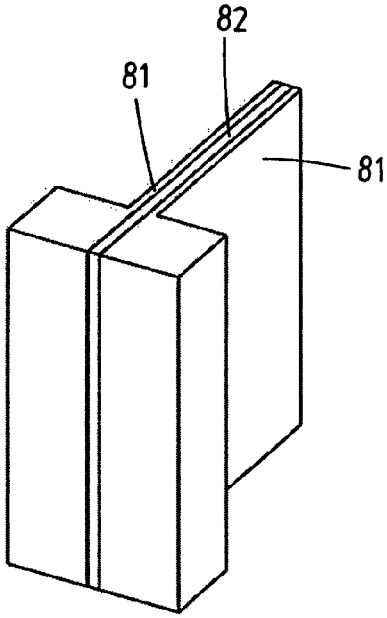
FIG. 4 shows a schematic view of a braking fin of the braking means of FIG. 2.

In FIG. 4 a possible embodiment of the braking member is shown. The braking member is formed as a laminate of different materials. For instance the outer parts 81 can be made of aluminium, and the inner layer 82 can be made of copper. Aluminium having the advantage that it leads to a lightweight structure, copper having the advantage of a stronger braking effect.

Figure 3A:
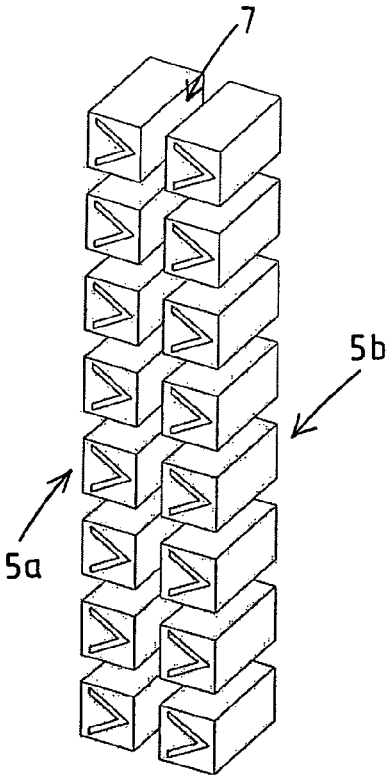
FIG. 3A-3C show in a schematical representation three alternative orientations of magnets in rows for the magnetic braking means of FIG. 2.
Figure 3B:
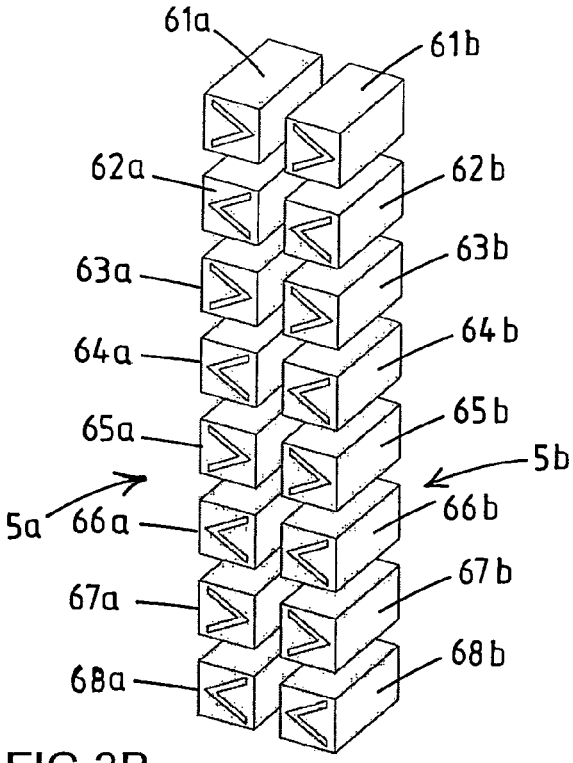
Figure 3C:
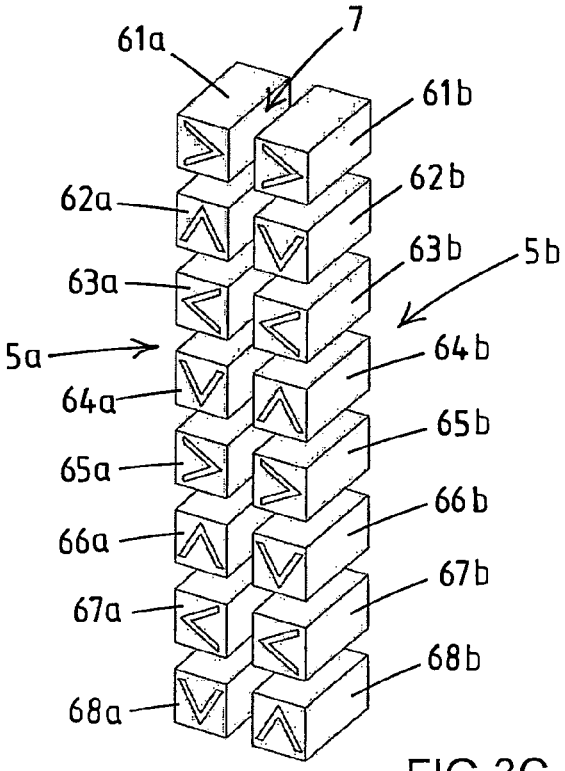

The permanent magnets 6 in the rows 5*a*, 5*b* of magnets can be oriented in different ways with respect to each other as is shown in FIGS. 3A-3C. In the FIGS. 3A-3C the arrow on each magnet 6 points towards the north pole of that particular magnet 6.

In FIG. 3A is shown a configuration wherein the magnets in the row 5*a* and in the row 5*b* are all directed in the same direction, which is a direction transverse, preferably orthogonal with respect to the slot 7.

In FIG. 3B is shown a configuration, wherein all magnets in both of the rows are directed in a direction transverse, preferably orthogonal with respect to the slot 7, and wherein consecutive magnets 6 in each row 5*a*, 5*b* are directed in an opposite direction. Corresponding magnets 6 in the two rows 5*a*, 5*b* are directed in the same direction. For illustrative purposes the magnets 6 of row 5*a* in FIG. 3B are numbered 61*a*-68*a* and the magnets 6 of row 5*b* are numbered 61*b*-68*b*. The first magnet 61*a* of row 5*a* is directed in the opposite direction as the second magnet 62*a* of row 5*a*. The third magnet 63*a* of row 5*a* is directed in the opposite direction of the second magnet 62*a* of row 5*a* and is in the same direction as the first magnet 61*a* and so on. The magnets 61*b*-68*b* of the second row 5*b* are configured the same as the magnets 61*a*-68*a* of the first row 5*a*. The configuration as is shown in FIG. 3B is referred to sometimes as the wiggler configuration. It is known that the wiggler configuration can result in a braking force which under like conditions which is four times higher than the braking force achieved with the configuration of FIG. 3A.

In FIG. 3C is shown a configuration wherein each magnet 6 in the row 5*b* is oriented 90° in clockwise direction relative to the previous magnet in the same row 5*a*. In the other row 5*a* each magnet 6 is oriented 90° in counter-clockwise direction relative to the previous magnet in the same row. Each magnet 6 of the first row 5*a*, directed transversely with respect to the slot 7, is directed in the same direction as the corresponding magnet in the other row 5*b*. Again for illustrative purposes the magnets 6 of row 5*a* in FIG. 3C are numbered 61*a*-68*a* and the magnets 6 of row 5*b* are numbered 61*b*-68*b*. The second magnet 62*a* of the first row 5*a* is directed 90° rotated counter clockwise with respect to the first magnet 61*a*. The third magnet 63*a* is rotated 90° counter clockwise with respect to the second magnet 62*a* and so on. The magnets 61*a*, 63*a*, 65*a* and 67*a* of the first row 5*a* that are directed transversely with respect to the slot 7 are directed in the same direction as the corresponding magnets 61*b*, 63*b*, 65*b*, 67*b* of the second row 5*b*. The magnets 62*a*, 64*a*, 66*a*, 68*a* of the first row 5*a* and the corresponding magnets 62*b*, 64*b*, 66*b*, 68*b* of the second row 5*b* are directed in opposite direction. This configuration of FIG. 3C is called the Halbach configuration.

In an alternative Halbach configuration (not shown), each magnet, directed transversely with respect to the slot, in one of the rows is directed in the opposite direction as the corresponding magnet. Each magnet directed upwards or downwards is then directed in the same direction as the corresponding magnet in the other row.

Figure 5:
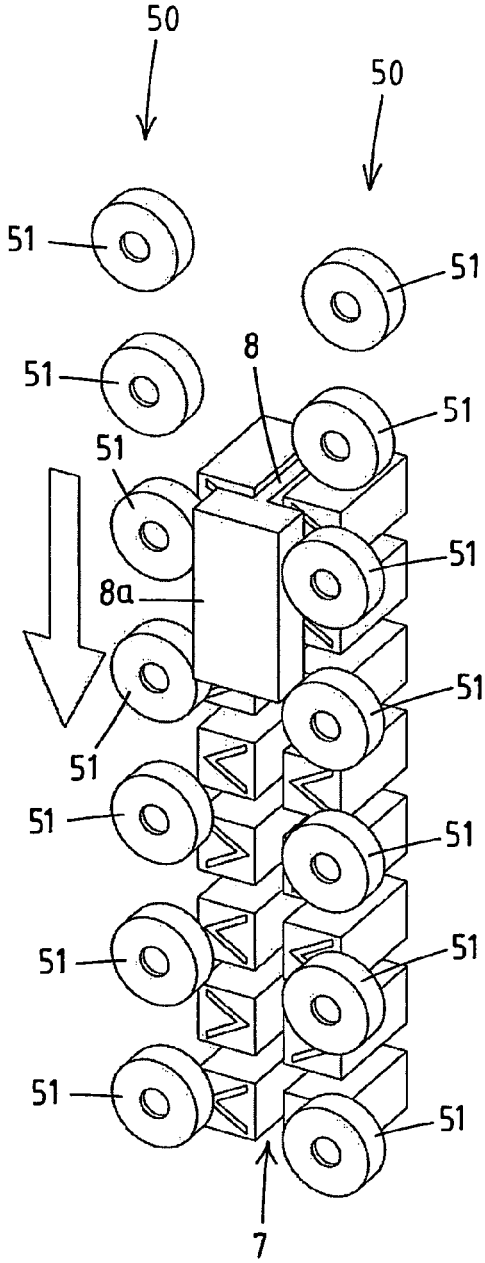
FIGS. 5A and 5B illustrate an automatic self alignment feature of a braking fin in a slot of the braking means.
FIG. 5C shows a carrying means provided with a spring connection between the carrying means and the fin.
FIG. 5D shows the carrying means on the guiding track during alignment of the fin into the slot.

In FIG. 5A is shown that an alignment feature is arranged in the region 3 where the rows 5*a*, 5*b* with magnets 6 are arranged. The alignment feature comprises two sets 50 of guiding wheels 51 which are attached to the guiding track 2. The sets 50 are mutually spaced such that the mounting block 8*a* attached to the fin 8 can travel between the two sets 50. By way of example each set in FIG. 5 has seven guiding wheels 51. In the region of the lower five wheels 51 the sets 50 are parallel and the wheels 51 engage on the side surface of the fin-mounting block 8*a* and guide the block 8*a*. In the upper portion of the sets 50, the mutual distance between the wheels 51 of the different sets 50 converges such that the block 8*a* with the fin 8 are aligned such that the fin automatically enters in the slot 7.

Figure 5B:
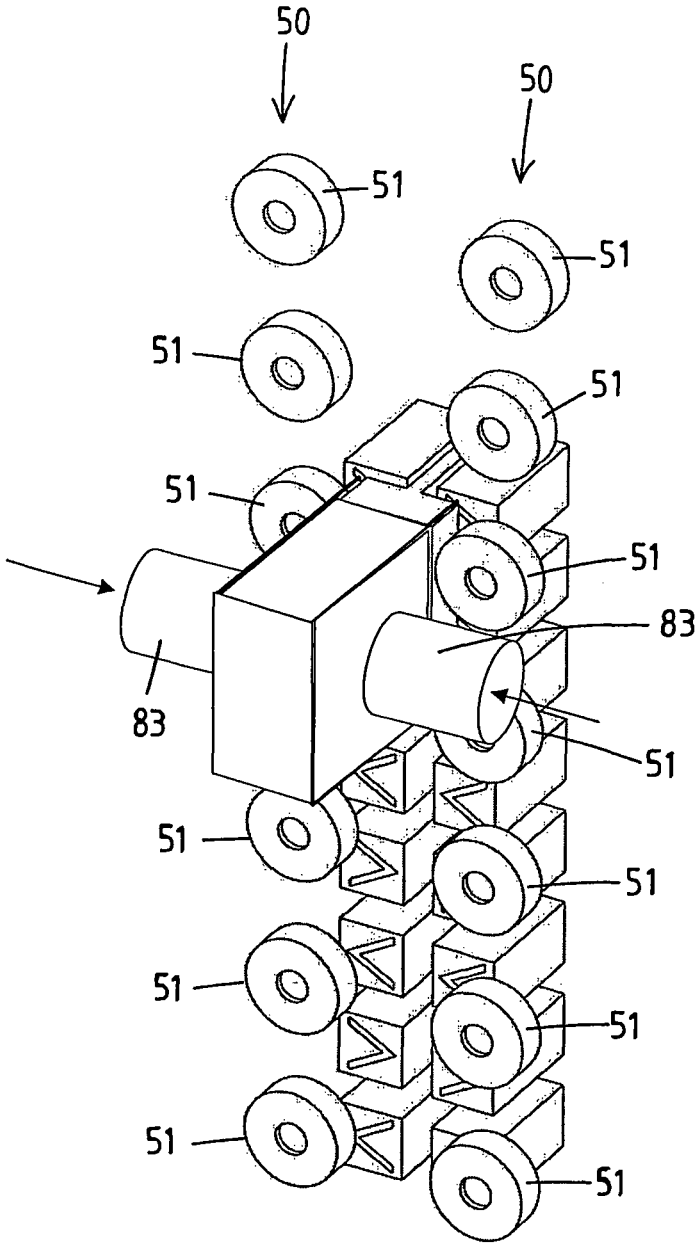

Preferably a set of springs 83 form a connection between the fin 8 and the carrying means as is shown schematically in FIG. 5B (the carrying means not shown in this figure). The springs 83 absorb shocks during the alignment of the fin 8 in the slot 7 by means of the wheels 51. It is also possible to have a rigid connection between the carrying means and the fin 8, in which case the person transported on the carriage will feel more shocks during descent.

Figure 5C:
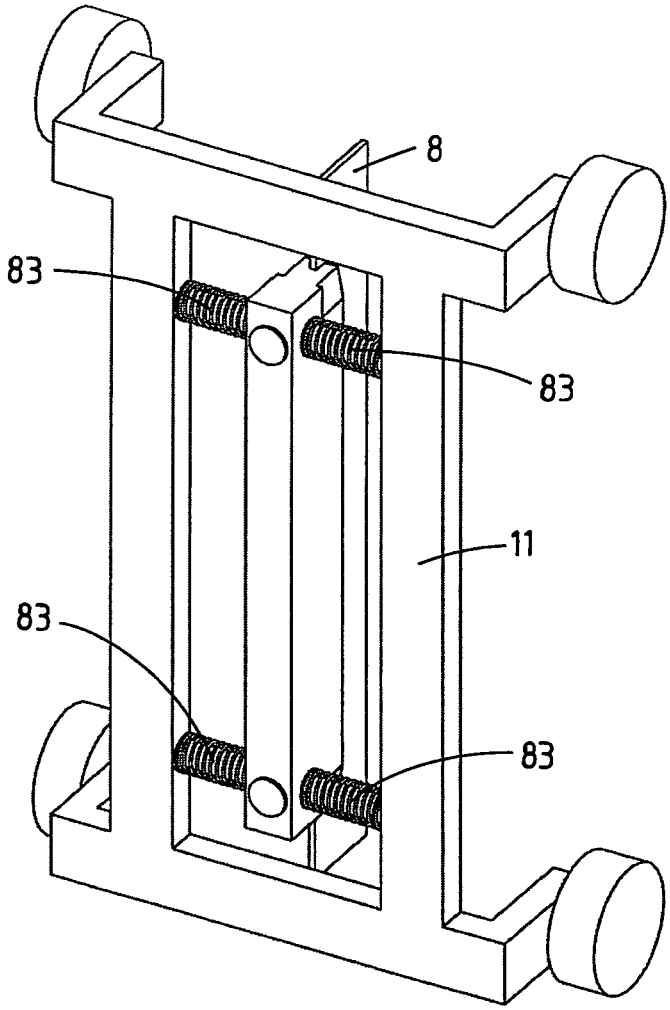

In FIG. 5C is shown how the fin 8 is connected to the carrying means 11 by in this example four springs 83.

Figure 5D:
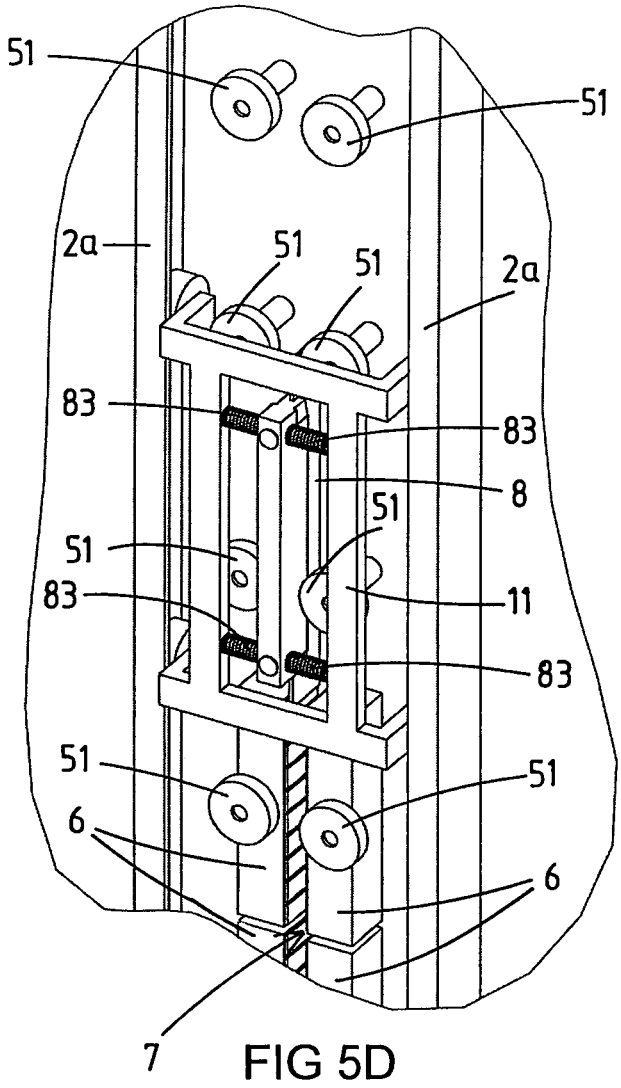

In FIG. 5D is shown how the carrying means 11 of FIG. 5C is running along the track 2 in the region 3 of the magnets 6.

Figure 6A:
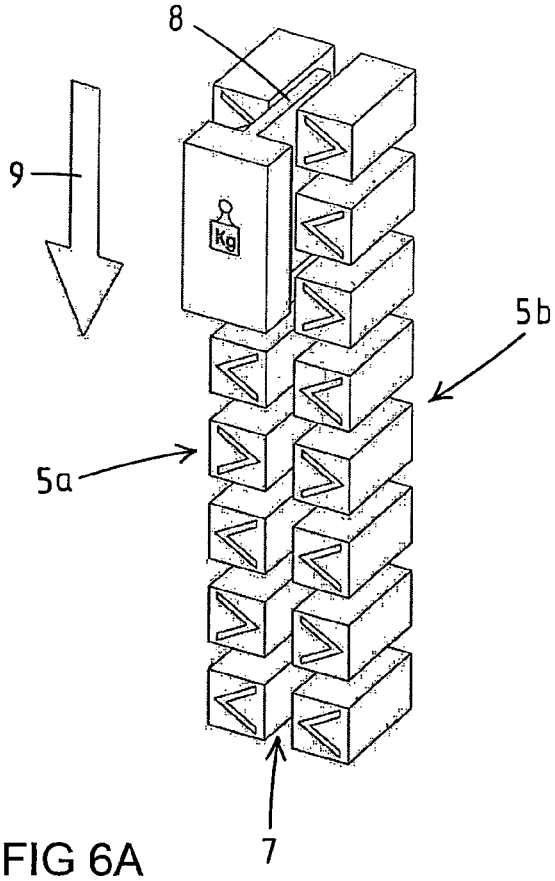
FIG. 6A and FIG. 6B illustrate the adaptation of the breaking means under the influence of different lighter and heavier weights to be braked.
Figure 6B:
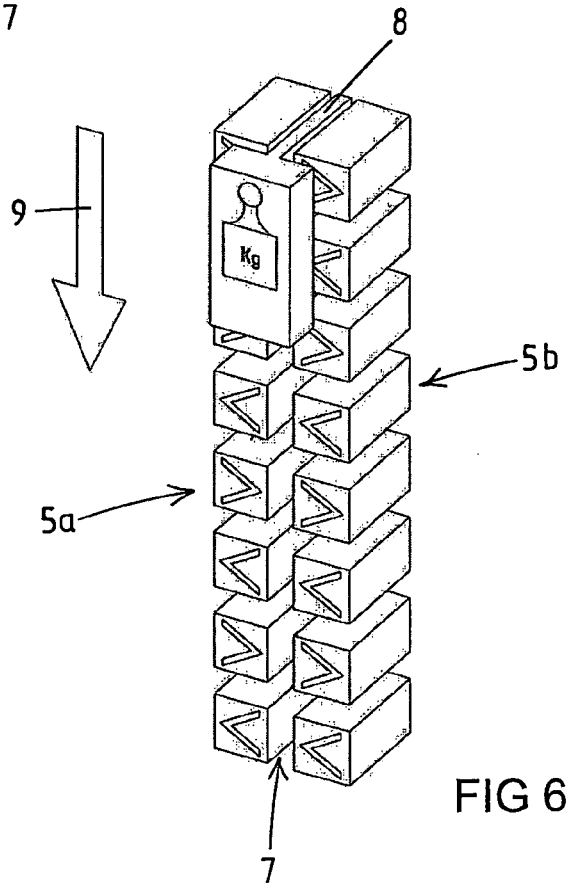

In FIG. 6A and FIG. 6B is illustrated how the fin 8 which is attached to the carrying means has a defined and self-adjusting, though limited, freedom of movement while being connected to the carrying means. This movement can be arranged in such a way that the braking force is governed by the weight of the person/load using the carrying means. When the person to be carried has a low weight, the fin 8 is retracted partly from the slot 7 (cf. FIG. 6A when compared to the situation where a person with a large weight has to be carried (cf. FIG. 6B). By this retraction of the fin a smaller surface of the fin travels through the magnetic field present in the slot and thereby the braking force is reduced. By adjusting this retraction of the fin 8 automatically by means of a (mechanical) control mechanism safely arresting the descent without operator intervention can be safeguarded. A more or less equal deceleration can be achieved, irrespective of the load. This results in that people can be transported along the track 2 at equal intervals without the risk of collision during descent.

Figure 6C:
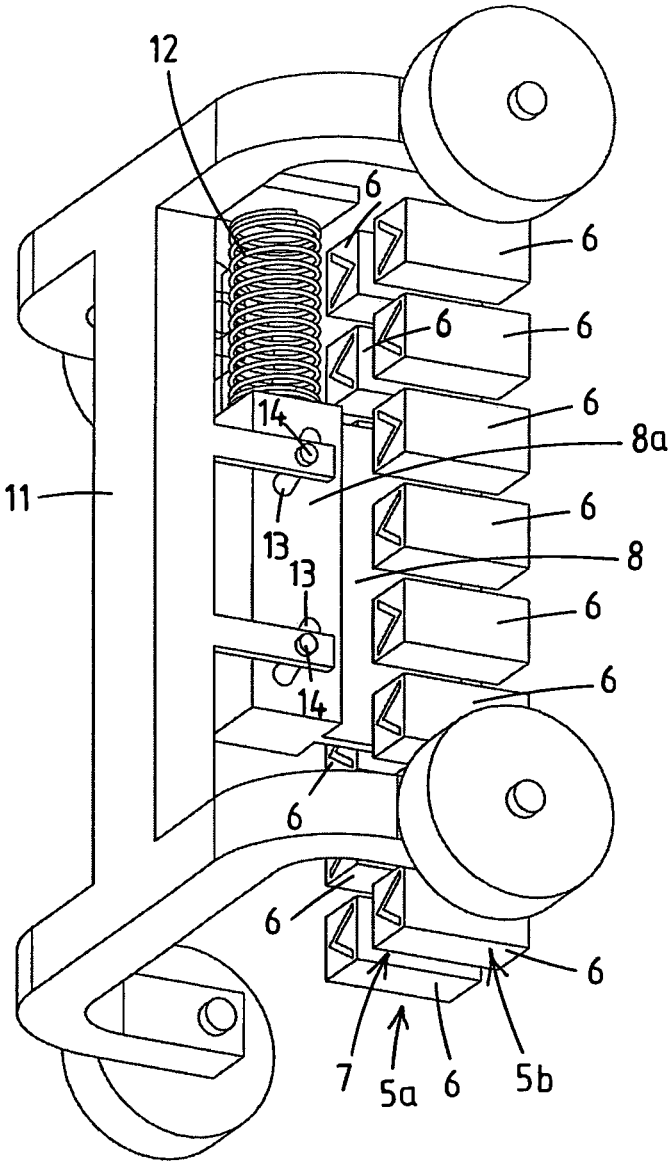
FIG. 6C shows a possible embodiment of a carrying means where the braking means are adapted as is illustrated in FIGS. 6A and 6B.

In FIG. 6C a possible embodiment of a carrying means 11 with a mechanical control mechanism for adjusting the retraction of the fin 8 in the slot 7 between the rows 5*a*, 5*b* of magnets 6 is shown. The fin 8, with its mounting block 8*a* is suspended from the frame of the carrying means 11 by means of a spring 12. In the example a helical spring is shown, however any suitable spring can be used, e.g. a leaf spring or a gas spring. The mounting block 8*a* is provided with guiding slots 13 extending obliquely with respect to the direction 9 of travel. In the guiding slots 13 guiding pins 14 are inserted, which guiding pins 14 are connected to the frame of the carrying means 11. When the mounting block 8*a* with the fin 8 is moved downwardly with respect to the frame of the carrying means 11, the fin 8 will be retracted further from the slot 7 between the magnets 6 through the cooperation of the guiding slots 13 and the guiding pins 14. During descent in the braking region 3, the fin 8 will be subjected to a braking force generated by the eddy currents. This braking force tends to push the fin 8 with its mounting block 8*a* upwardly with respect to the frame of the carrying means 11 against the spring force of the spring 12 thereby inserting the fin 8 into the slot 7. The fin 8 will search for an equilibrium between the velocity determined braking force and the spring force. Thereby an automatic adjustment of the braking force is achieved.

Figure 7A:
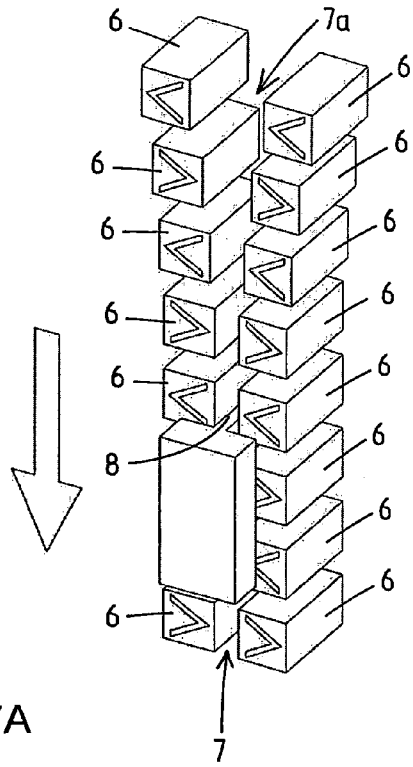
FIG. 7A-7C show in a schematical representation alternative embodiments of the magnetic braking means for mitigating peak loads in G-force.
Figure 7B:
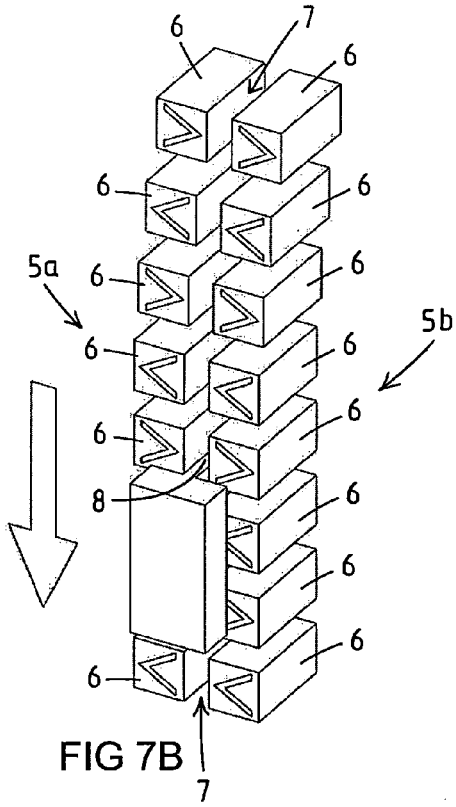
Figure 7C:
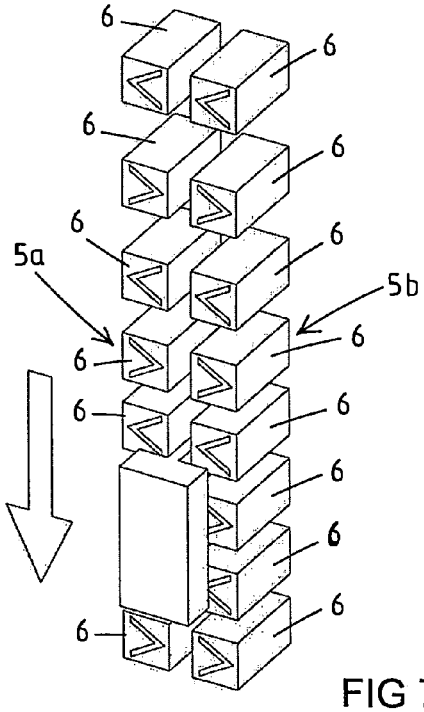

In FIG. 7A-7C three alternative embodiments of the magnetic braking means are shown by which peak loads at the start of the braking, that is when the complete fin 8 has just entered the upper portion of the slot 7, can be mitigated. A second objective of these embodiments is to achieve the same maximum deceleration for different loads (persons) irrespective of weight.

In one embodiment (FIG. 7A) the rows 5*a*, 5*b* of magnets 6 have an entrance curve, such that in upper part 7*a* of the slot 7 the distance between the magnets 6 of the two rows is greater and converges to a constant width of the slot 7.

In another embodiment, which is shown in FIG. 7B the rows 5*a* and 5*b* have an entrance curve such that the upper magnets 6—in the example shown the upper three magnets 6—of the rows 5*a*, 5*b* are positioned backward and following the entrance curve come forward towards a flat plane. In this way the slot 7 has an entrance curve in which, upon descent of the carriage, gradually more surface area of the fin 8 is located within the slot 7 and thus the brake's effect is gradually increased.

In yet another embodiment, which is shown in FIG. 7C, the mutual distance between the consecutive magnets 6 of one row 5*a* and 5*b* respectively, starting from the upper magnet 6 of the row, is decreased gradually to a constant distance. In this manner also the effect of the brake is increased gradually upon descent of the carriage.

A combination of the embodiments of FIG. 7A-7C is also conceivable, thus with magnet rows with two or three dimensional entrance curves. It also possible to make the magnets 6 moveable with respect to the guiding track 2, such that the entrance curves can be adapted to the circumstances.

Figure 8:
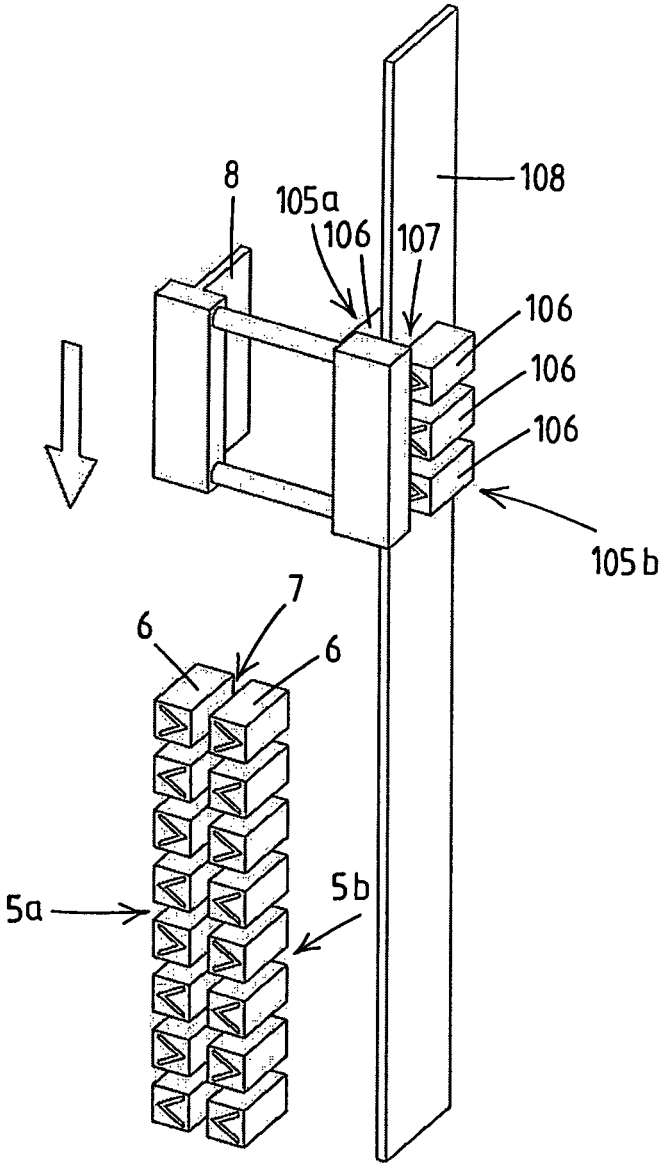
FIG. 8 shows in a schematic representation a preferred embodiment of magnetic braking means according to the invention, provided with intermediate braking means.

In FIG. 8 is shown an embodiment of the braking means comprising intermediate braking means. In this embodiment the carrying means (not shown) has, like the embodiments described above, a braking fin 8, which in a lower region of the guiding track 2 travels through a slot 7 between two rows 5*a*, 5*b* of permanent magnets 6. Furthermore there is provided a fin 108 which is attached to the guiding track 2, which fin 108 extends along a considerable length or the whole length of the guiding track 2. The carrying means is furthermore provided with two rows 105*a* and 105*b* of permanent magnets 106 which delimit between them a slot 107. The fin 108 is received within the slot 107 between the rows 105*a*, 105*b* of magnets 106. Upon descent of the carrying means along the track the fin 108 travels relatively seen through the slot 107 whereby a braking force is generated through the generation of eddy currents in the same manner as is described above. The magnets 106 attached to the carrying means and the stationary fin 108 extending along the track are used as intermediate braking means such that the velocity during descent is kept within safe and comfortable limits, and to mitigate peak deceleration during final braking.

Figure 9A:
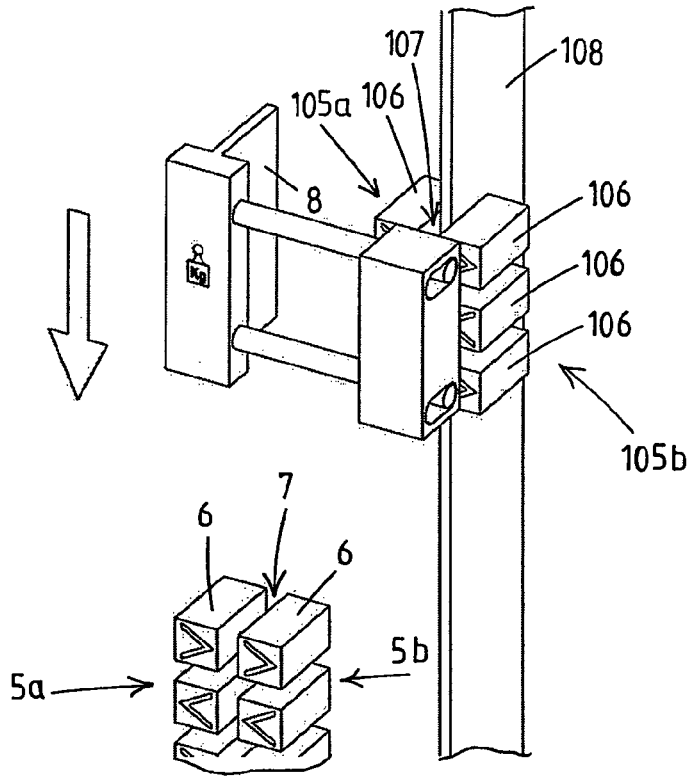
FIG. 9A and FIG. 9B in a schematic representation a preferred embodiment of magnetic braking means according to the invention, provided with adjustable intermediate braking means.
Figure 9B:
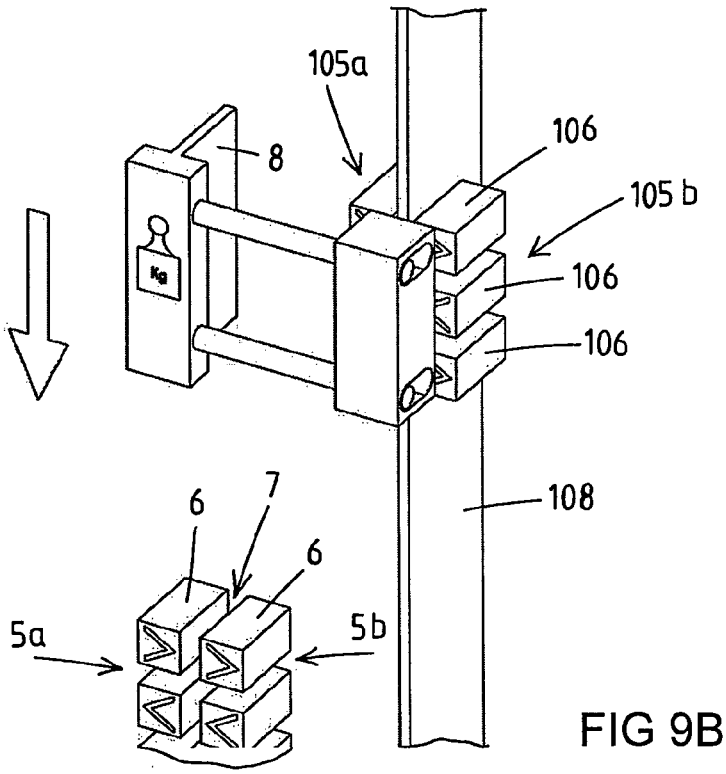

In FIGS. 9A and 9B is shown a further preferred embodiment of the braking means comprising intermediate braking means. In this embodiment the magnets 106 attached to the carriage are moveable such that the slot 107 can be moved backward and forward with respect to the fin 108. In this manner the surface area of the fin 108 that is passed through the slot 107 can be adjusted, whereby the braking force generated in the intermediate braking means can be adjusted depending on the circumstances, for instance limiting the speed of heavier persons to ensure maintaining sufficient separation between successive users. It is possible to automatically adjust the position of the magnets 106 as a function of the velocity and the weight of the person to be carried by the carrying means. To this end a (mechanical) control mechanism—possibly similar to the one described in connection with FIG. 6C—can be provided to safely control the descent velocity without operator intervention. Another embodiment could enable manually or automatically presetting the intermediate brake before descent, based on the weight of the user.

Figure 10A:
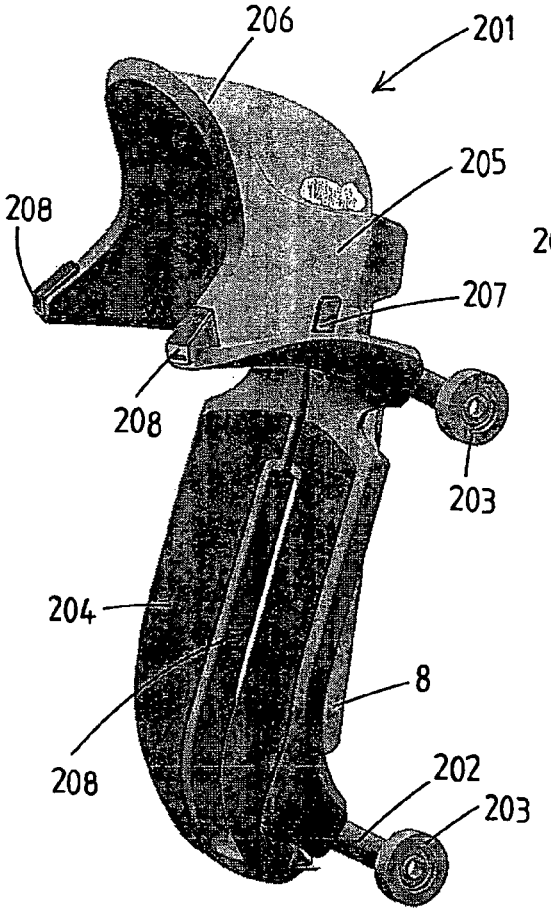
FIG. 10A and FIG. 10B show a perspective view of a preferred embodiment of a carriage to be used in a rescue arrangement according to the invention.
Figure 10B:
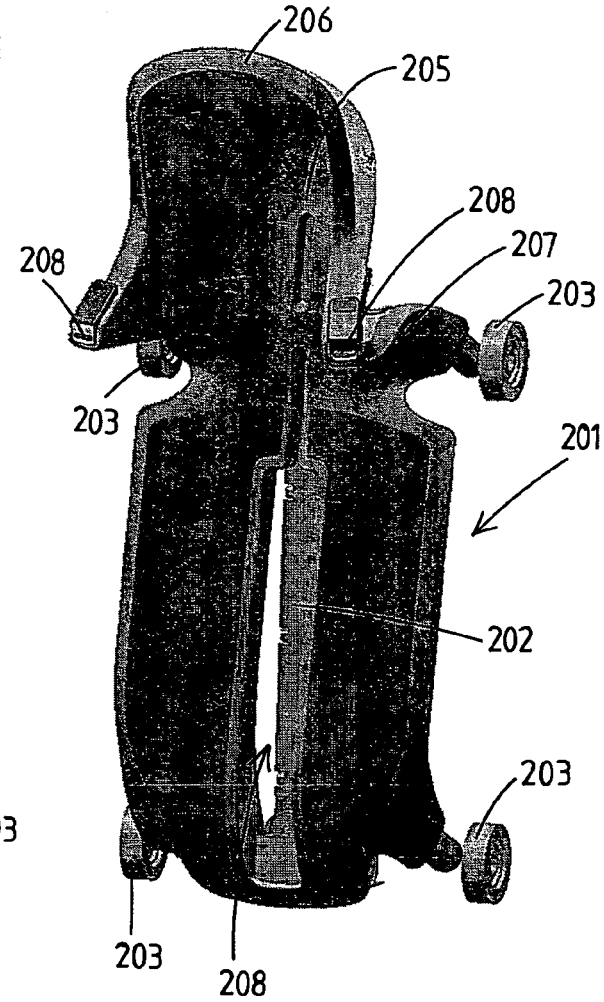
Figure 11A:
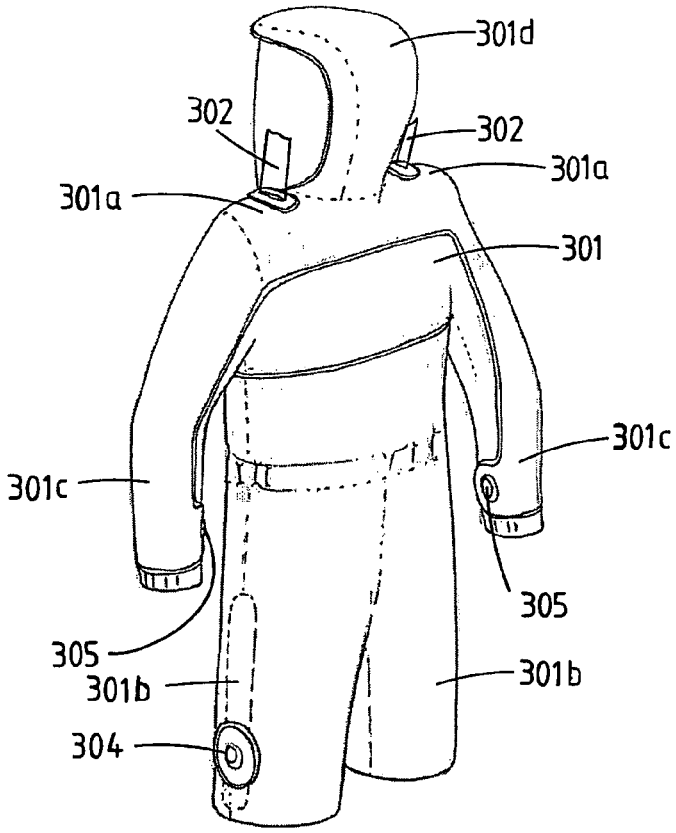
FIG. 11A and FIG. 11B show a perspective view from the rear and from the front respectively of a rescue suit to be used with a carriage of FIG. 10.
Figure 11B:
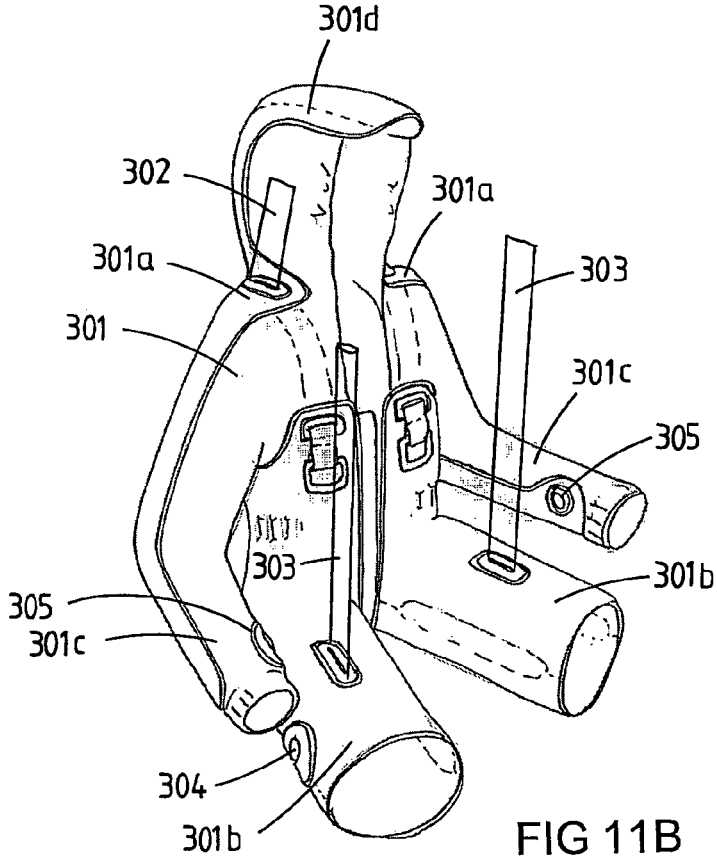

In a preferred embodiment of the invention the carrying means 11 comprise a carriage and a rescue suit to be worn by a person. In FIG. 10A and FIG. 10B a possible embodiment of the carriage 201 is shown, which carriage 201 is adapted to be connected to the guiding means 2 so as to descend along the guiding means. A rescue suit 301 is shown in FIG. 11A and FIG. 11B. The rescue suit 301 is adapted to be coupled to the carriage 201.

The carriage 201 has a frame 202, or is formed as an integrated structure, that is carrying four wheels 203 that are adapted to roll over or within the rails 2*a* of the guiding track 2. The frame can be made metal, preferably a light metal or a plastic material. A shell, preferably made of plastic material defines a backrest 204 and a headrest 205. The shell is integrated with the structure or attached to a front side of the frame. Furthermore, a braking member, in particular the fin 8 as is described in the above, is arranged to a back side of the frame 202. At the headrest 205 of the carriage a head shelter 206 is formed for protecting the head of a person travelling with the carriage 201 from falling debris.

Figure 12:
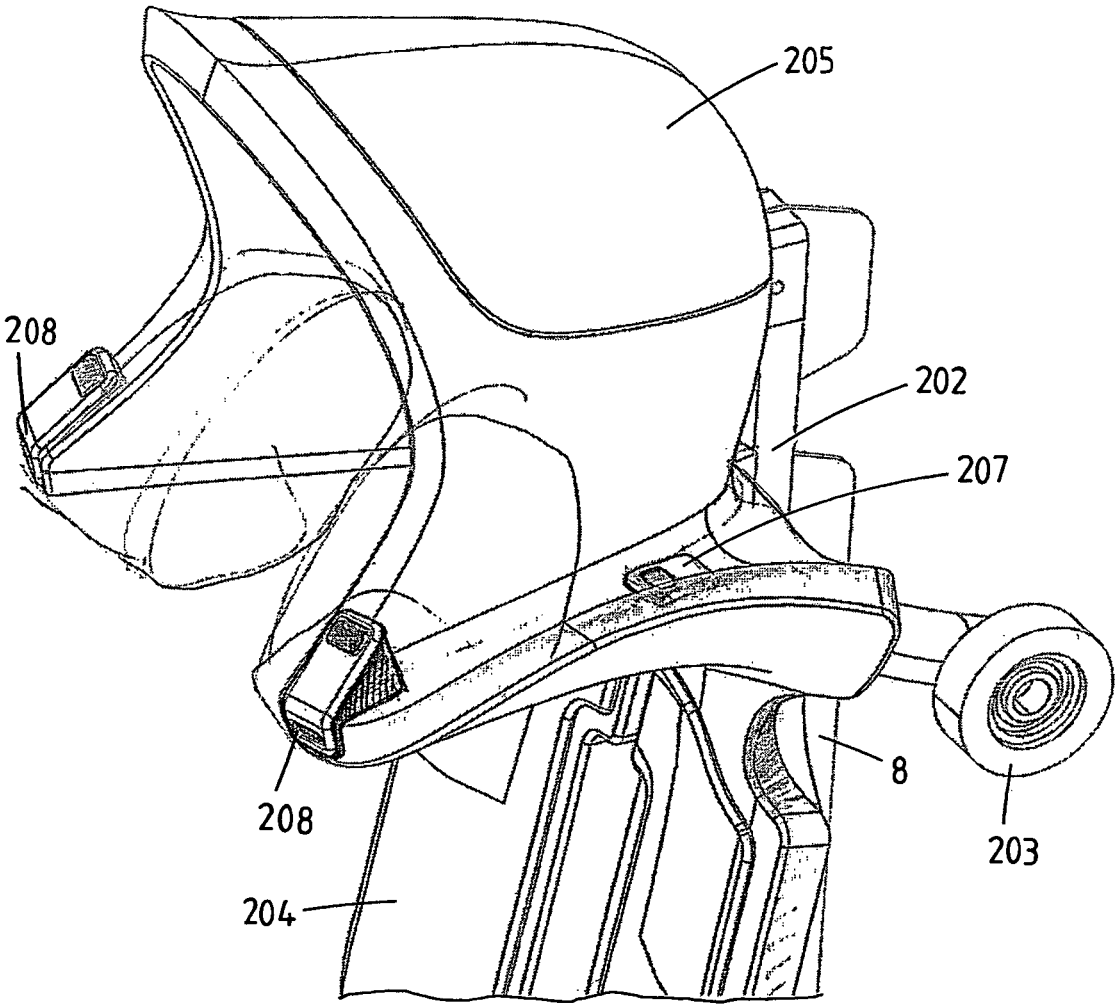
FIG. 12 shows a perspective view of an upper portion of the carriage of FIG. 10.

In FIGS. 11A and 11B as well as from FIG. 12 can be seen that the carriage 201 at its upper portion is provided with suspension brackets 207 and 208 on each side from which the rescue suit can be suspended by straps. On each side is provided a shoulder suspension bracket 207 and a leg suspension bracket 208. In use the rescue suit 301 is suspended from the shoulder suspension brackets 207 by shoulder suspensions or straps 302 that are connected to shoulder portions 301*a* of the suit 301. Furthermore an upper leg portion 301*b* of the suit 301 is suspended from the leg suspension bracket 208 by leg suspension straps 303 that are connected to the leg portions 301*b* of the suit 301. When suspended the upper leg portions 301*b* are kept in a lifted position as is illustrated in FIG. 11B. Preferably the leg suspension straps at the upper leg region of the suit are adapted to automatically release the legs after braking and immediately prior to the release of the carriage from the guiding means so that the escapee can walk while still wearing the suit/carriage.

The rescue suit 301 has coupling means 304 at the side of the upper leg portion 301*b* of the suit 301 and coupling means 305 at an arm portion 301*c* near the wrist region. The coupling means 304 and 305 can be coupled so as to couple the arm portion 301*c* to the upper leg portion 301*b* such that during descent the arms of the person wearing the suit 301 keeps the arms along his/her torso. In this manner the rescue suit 301 keeps the person wearing it from (unintentionally or otherwise) wildly swinging his/her arms which could cause injury during the rapid descent from the building.

The rescue suit also has a head portion 301*d* formed as a cap for covering the head of the person wearing the suit 301, which cap restrains items such as long hair that might otherwise be caught inadvertently and undesirably during descent.

Figure 13:
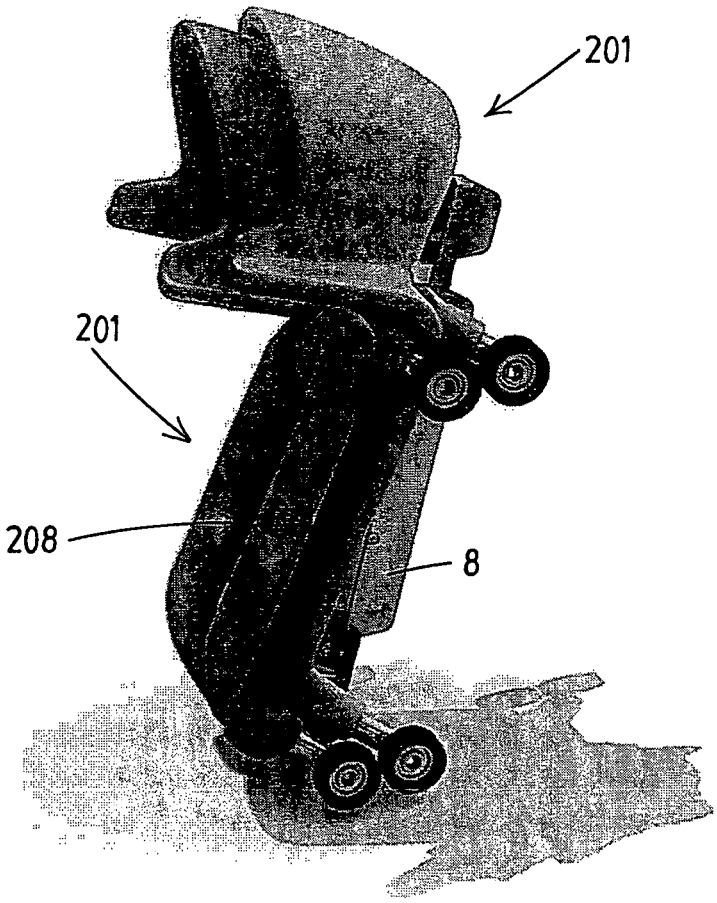
FIG. 13 shows a perspective view of two carriages of FIG. 10 in a stacked state.
Figure 15:
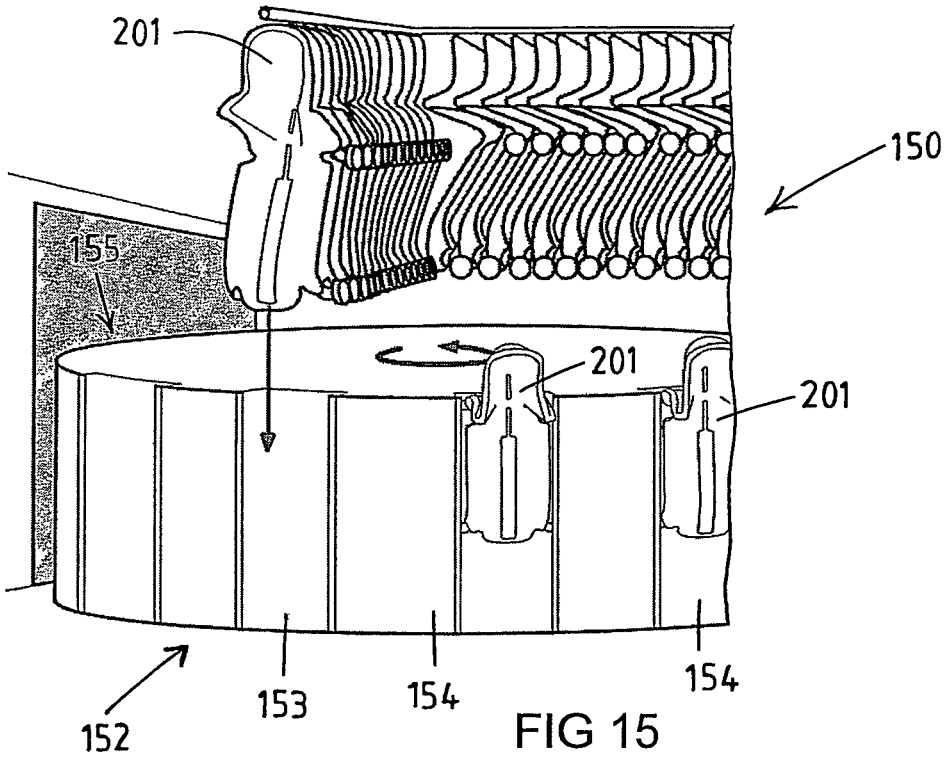
FIG. 15 shows a preferred embodiment of a feed location of carriages of a rescue arrangement according to the invention.
Figure 16:
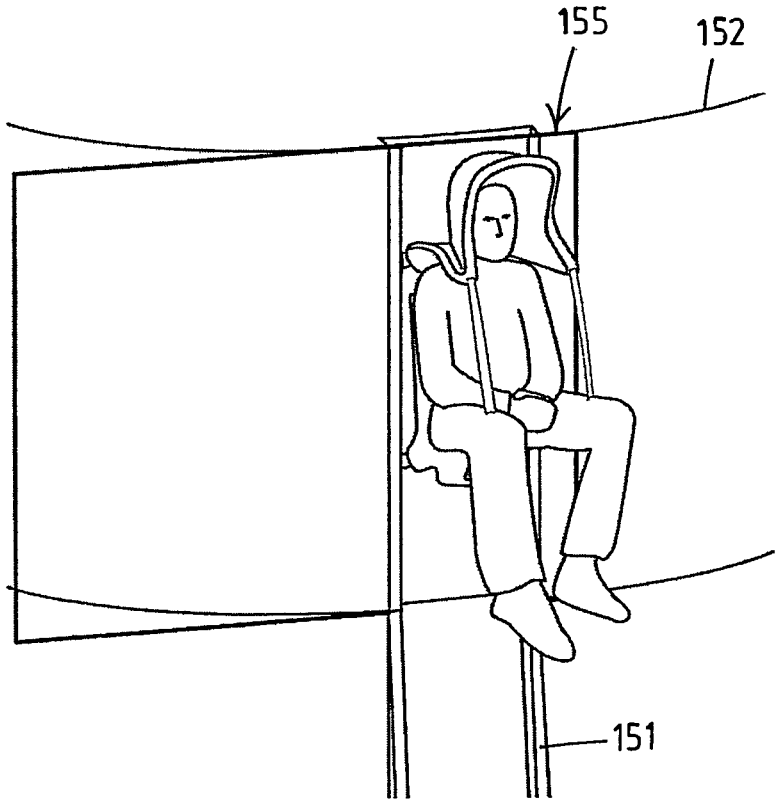
FIG. 16 illustrates the feeding of a carriage to a feed track of the rescue arrangement.
Figure 17:
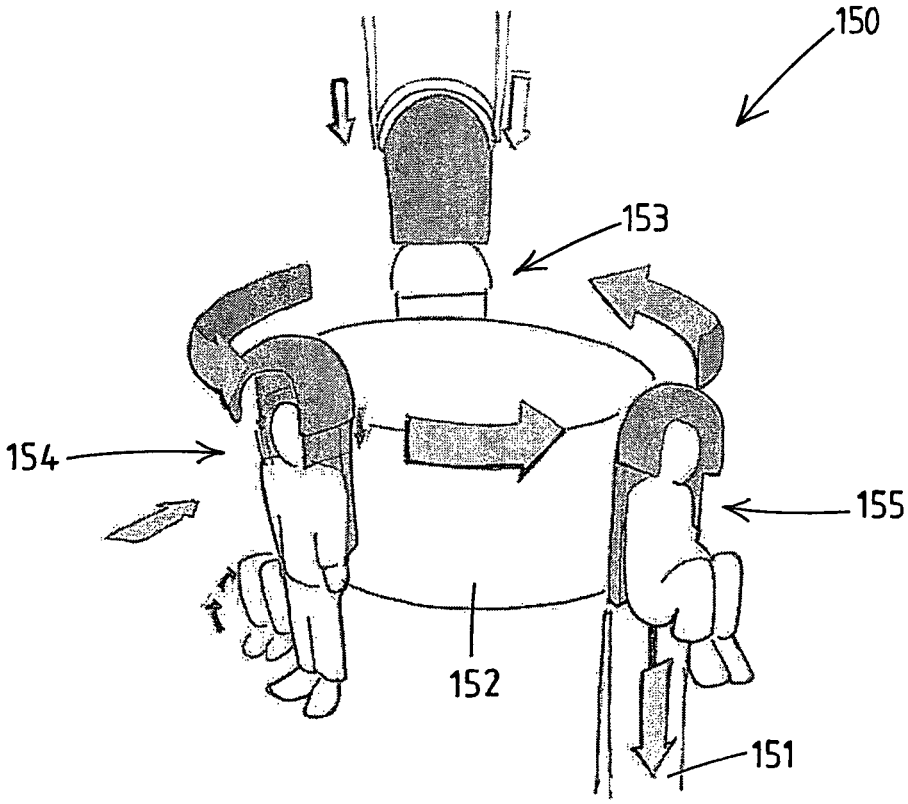
FIG. 17 shows schematically a carrousel used to place people in a carriage and feeding them to the feed track.

As is shown in FIG. 13 the carriages 201 are designed such that they are stackable. In this manner the carriages can be stored on an upper part of a building, e.g. on a roof. The persons in the building can be all provided with a personal rescue suit 301, which they can put on in case of an emergency. This is comparable with an airplane where each passenger has a life vest stowed under his seat. They can then proceed towards a feed location 150 where carriages 201 are stacked as is shown in FIG. 15. Trained staff can then attach each person to an individual carriage 301 which is then be placed on a feed track 151 (cf. FIG. 16 and FIG. 17). Placing the carriage 201 on the feed track 151 can be arranged by a carrousel feed system 152, which at station one 153 is loaded with at least one carriage as is shown in FIG. 15 and FIG. 17, which at station two 154—which can be one station as is shown in FIG. 17 or more stations as is illustrated in FIG. 15—can be loaded with one or more persons, and at the final station 155 is fed towards the guiding means 2. Next, the carriage can be moved to the guiding means 2 and can be released for the rapid descent. At the lower end of the guiding means the carriages 201 are dropped off with the persons carrying them. After the persons have moved out of the way of the next descending person the carriage 201 can be taken off and stacked again.

Figure 14A:
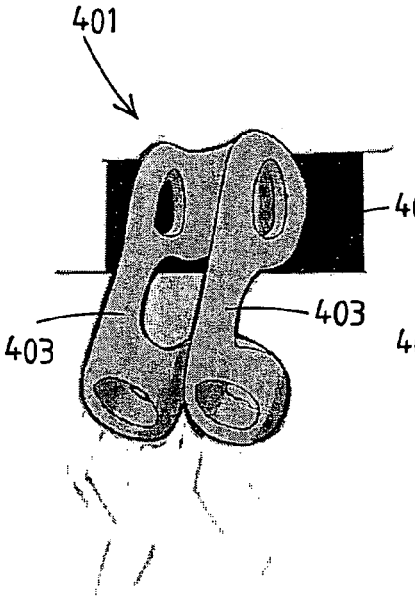
FIG. 14A-14C show in different views, a rescue suit with an integrated carriage for use in a rescue arrangement according to the invention.
Figure 14B:
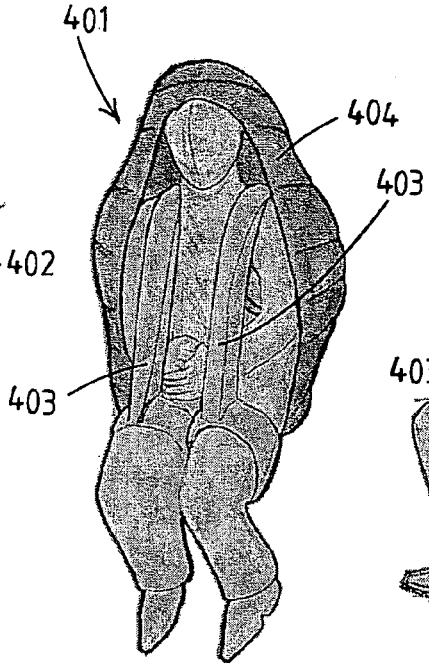
Figure 14C:
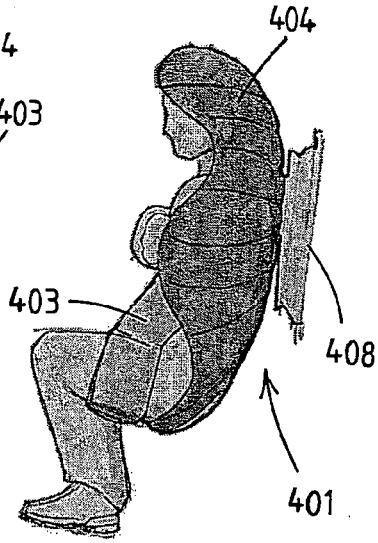

As an alternative to a separate carriage 201 and rescue suit 301 to be coupled before descent, the carrying means can also comprise a carriage and a rescue suit being integrated into a single item. In this embodiment of which an example is shown in FIG. 14A-14C. The carriage 402 is integrated into the back of the rescue suit 401. The suit 401 comprises tension bands 403 (see FIG. 14A) connecting legs and shoulders. The tension bands 403 keep the legs of the person raised as is shown in FIG. 14B en 14C but allow standing and walking after descent when the carriage 402 is decoupled from the guiding means. The suit 401 furthermore comprises a sort of turtle shell 404 which covers at least the head, the back and the side of the torso, such that the body is protected and the arm movement is restricted. The wheels, fins and intermediate brakes (not shown) as described above are integrated into the back of shell 404 and represented simplistically within these diagrams as part 408.

The invention claimed is:

1. A rescue arrangement for effecting a rapid descent from a higher level to a lower level, the rescue arrangement comprising:

guiding means which extend between the higher level and the lower level, carrying means which are connectable to the guiding means for carrying a person or another object from the higher level to the lower level along the guiding means, magnetic braking means located on the guiding means or the carrying means for slowing down the carrying means at least near the lower end of the guiding means, wherein the magnetic braking means comprise a series of permanent magnets, wherein at least two substantially parallel rows of permanent magnets are arranged along the guiding means near its lower end, said rows delimiting at least one slot between them and wherein the carrying means are provided with at least one braking member, which travels within the slot between the rows of magnets at the end stage of the descent of the carrying means along the guiding means, wherein the slot has an upper portion where the rows of magnets are positioned such that when the braking member has entered said upper portion of the slot, the brake effect gradually increases and peak loads can be mitigated, and wherein at the upper portion of the slot the rows of magnets have an entrance curve, such that the distance between the magnets of the two rows converges from a greater distance towards a constant width of the slot, preferably with a V-shape.

2. The rescue arrangement according to claim 1, wherein the magnetic braking means comprise a series of permanent magnets arranged at least near the lower end of the guiding means.

3. The rescue arrangement according to claim 1, wherein the braking member is formed as a fin.

4. The rescue arrangement according to claim 1, wherein the braking member is made from an electrically conductive material.

5. The rescue arrangement according to claim 1, wherein the braking member is made from a non-ferromagnetic material.

6. The rescue arrangement according to claim 1, wherein each magnet in one of the rows is directed in the same direction as the corresponding magnet in the other row.

7. The rescue arrangement according to claim 1, wherein the magnets are chosen and configured in such a way that the carrying means at the end of the guiding means has a residual, steady movement.

8. The rescue arrangement according to claim 1, wherein magnetic brakes are arranged along most of the length of the guiding means so as to provide an intermediate braking along the track.

9. The rescue arrangement according to claim 1, wherein at least two substantially parallel rows of permanent magnets are arranged on the carrying means, said rows delimiting at least one slot between them, and wherein the guiding means are provided with at least one braking member, over which the slot between the rows of magnets travels during at least part of the descent of the carrying means along the guiding means.

10. The rescue arrangement according to claim 1, wherein the guiding means at the lower end are adapted to allow the carrying means to be dropped off or out.

11. The rescue arrangement according to claim 1, wherein the guiding means comprise a track defined by rails.

12. The rescue arrangement according to claim 1, wherein the guiding means have multiple feeding tracks from which the carrying means can be fed to the descending guiding means.

13. The rescue arrangement according to claim 1, wherein the carrying means comprise a carriage and a rescue suit to be worn by a person.

14. The rescue arrangement according to claim 1, wherein each magnet in one of the rows is directed in the same direction as the corresponding magnet in the other row, wherein consecutive magnets in each row are directed in a diametrically opposite direction (180° rotation), being transverse to the direction of the slot.

15. The rescue arrangement according to claim 1, wherein at least two substantially parallel rows of permanent magnets are arranged on the carrying means, said rows delimiting at least one slot between them, and wherein the guiding means are provided with at least one braking member, over which the slot between the rows of magnets travels during at least part of the descent of the carrying means along the guiding means, wherein each magnet in one of the rows is directed in the same direction as the corresponding magnet in the other row.

* * * * *